US011401109B2

(12) United States Patent
Searle et al.

(10) Patent No.: US 11,401,109 B2
(45) Date of Patent: Aug. 2, 2022

(54) REFUSE COLLECTION DEVICE

(71) Applicant: Bucher Municipal Pty Ltd, Victoria (AU)

(72) Inventors: Andrew Peter Searle, Victoria (AU); Andrew Garry Mitchell, Victoria (AU); Lewis Luyken, Victoria (AU)

(73) Assignee: Bucher Municipal Pty Ltd, Victoria (AU)

( * ) Notice: Subject to any disclaimer, the term of this patent is extended or adjusted under 35 U.S.C. 154(b) by 0 days.

(21) Appl. No.: 16/636,125

(22) PCT Filed: Aug. 8, 2018

(86) PCT No.: PCT/AU2018/050835
§ 371 (c)(1),
(2) Date: Feb. 3, 2020

(87) PCT Pub. No.: WO2019/028514
PCT Pub. Date: Feb. 14, 2019

(65) Prior Publication Data

US 2020/0180860 A1 Jun. 11, 2020

(30) Foreign Application Priority Data

Aug. 11, 2017 (AU) ..... 2017903209

(51) Int. Cl.
*B65F 3/04* (2006.01)
*B65F 3/02* (2006.01)

(52) U.S. Cl.
CPC ..... *B65F 3/046* (2013.01); *B65F 3/0203* (2013.01); *B65F 2003/023* (2013.01);
(Continued)

(58) Field of Classification Search
CPC .. B65F 3/0203; B65F 3/046; B65F 2003/023; B65F 2003/0266; B65F 2003/0273; B65F 2003/0276; B65F 2003/0283
See application file for complete search history.

(56) References Cited

U.S. PATENT DOCUMENTS 2,933,210 A * 4/1960 Dye ..... B65F 3/0203 414/547
3,604,577 A * 9/1971 Heilmeier ..... B65F 3/04 414/421

(Continued)

FOREIGN PATENT DOCUMENTS

DE 19706539 A1 * 8/1998 ..... B65F 3/041
DE 20312139 10/2003

(Continued)

OTHER PUBLICATIONS

International Search Report issued in related PCT/AU2018/050835, dated Oct. 23, 2018.

*Primary Examiner* — James Keenan
(74) *Attorney, Agent, or Firm* — Barnes & Thornburg LLP; Jeffrey R. Stone

(57) ABSTRACT

A refuse collection device mountable to a refuse collection vehicle having a first chassis rail and a second chassis rail, the device including: a base; a rotating member rotatably connected to the base about a first rotational axis; an extension member that is supported by the rotating member and configured to extend relative to the rotating member; a lifting member rotatably connected to the extension member for rotation about a second rotational axis; and a bin-grabbing member that is connected to the lifting member, the bin-grabbing member being configured to collect a bin, the device configured to mount to the vehicle to locate the first
(Continued)

rotational axis of the rotation member between the first chassis rail and the second chassis rail.

15 Claims, 3 Drawing Sheets

(52) U.S. Cl.
CPC ..... *B65F 2003/0266* (2013.01); *B65F 2003/0269* (2013.01); *B65F 2003/0273* (2013.01); *B65F 2003/0276* (2013.01)

(56) References Cited

U.S. PATENT DOCUMENTS 3,730,367 A * 5/1973 Heffington ..... B65F 3/0203 414/501
3,762,586 A * 10/1973 Updike, Jr. ..... B65F 3/04 414/408
3,765,554 A * 10/1973 Morrison ..... B65F 3/04 414/408
3,841,508 A * 10/1974 Ebeling ..... B65F 3/06 414/406
3,942,601 A * 3/1976 Smith ..... B65F 3/00 414/546
3,954,194 A * 5/1976 Stedman ..... B65F 3/0203 414/550
4,175,903 A * 11/1979 Carson ..... B65F 3/04 414/408
5,967,731 A * 10/1999 Brandt ..... B65F 3/04 414/408
6,183,185 B1 * 2/2001 Zanzig ..... B65F 3/206 414/408
7,072,745 B2 * 7/2006 Pillar ..... B65F 3/046 414/408
8,998,555 B1 4/2015 Ingham
2003/0031543 A1 * 2/2003 Elbrink ..... B65F 3/201 414/408

FOREIGN PATENT DOCUMENTS

DE 102015003702 A1 * 9/2016 ..... B65F 1/122
EP 0078011 5/1983
EP 3150513 4/2017
WO 97/07040 2/1997
WO WO-2015059319 A1 * 4/2015 ..... B65F 3/0203
WO 2015/150956 10/2015
WO WO-2017079791 A * 5/2017 ..... G07C 5/00

* cited by examiner

REFUSE COLLECTION DEVICE

FIELD OF THE INVENTION

The invention relates to a refuse collection device. In particular, the invention relates, but is not limited, to a refuse collection device for a side loading refuse collection vehicle.

BACKGROUND OF THE INVENTION

Reference to background art herein is not to be construed as an admission that such art constitutes common general knowledge in Australia or elsewhere.

Several different types of refuse collection vehicles are used in collecting municipal waste, including rear loading, front loading and side loading vehicles. By way of example, side loading refuse collection vehicles (or 'side loaders') typically employ a hydraulically actuated telescoping pickup arm, with an end claw acting as a grabbing means to seize and lift bins and to tip their contents into the vehicle's collection hopper. An advantage of side loading refuse collection vehicles is that a vehicle driver/operator does not normally need to leave their seat to carry out a bin emptying operation.

However, one difficulty in using side loading refuse collection vehicles is the accurate positioning of the vehicle. The driver/operator is required to align the bin lifting device with the selected bin and ensure the area is free from pedestrians and other obstacles before operating the bin collection device. To address this difficulty, dual steer refuse collection vehicles are commonly used. A dual steer vehicle affords the ability to drive and operate the vehicle from either side, and particularly from the kerbside, the side from which bins are collected.

A downside of dual steer vehicles is that they generally require a conversion from a standard vehicle, and this modification can be costly.

Further, conventional side loading refuse collection vehicles can encounter difficulty in navigating particular obstacles, bin positioning and layouts of collection areas. For example, when bins are placed in close proximity to each other, it can be difficult to grab one bin without knocking one or more surrounding bins over, requiring time-consuming manual intervention. Indeed if there are any other obstacles close to a bin, typically the obstacle needs to be moved or the bin repositioned before the collection operation can be initiated.

The pickup of bins requires time and care to both stop the vehicle at a correct position relative to the bin and to align the pickup arm with the bin to be collected, which can be a particular problem in difficult access areas such as cul-de-sacs and narrow roads. This can lead to increased time and vehicle running costs. Reducing the overall pickup time for bins can therefore give rise to significant commercial advantage.

Allied to the problems above, there can be a high cognitive load on the driver/operator, who must concentrate on many different things, including aligning and positioning the vehicle, checking for pedestrians and obstacles in the vicinity, and operating the bin collection mechanism at the right time. Lapses in operator concentration can be hazardous, and approaches that can allow reduction of the overall cognitive load on the driver/operator can potentially provide substantial safety benefits.

SUMMARY OF THE INVENTION

In one aspect, although not necessarily the only or broadest form, the invention resides in a refuse collection device mountable to a refuse collection vehicle having a first chassis rail and a second chassis rail, the device including:

- a base;
- a rotating member rotatably connected to the base about a first rotational axis;
- an extension member that is supported by the rotating member and configured to extend relative to the rotating member;
- a lifting member rotatably connected to the extension member for rotation about a second rotational axis; and
- a bin-grabbing member that is connected to the lifting member, the bin-grabbing member being configured to collect a bin,
- the device configured to mount to the vehicle to locate the first rotational axis of the rotation member between the first chassis rail and the second chassis rail.

The rotating member provides the refuse collection device with significant additional flexibility in a bin collecting operation, reducing the need to accurately position the refuse collection vehicle for bin pickup, and allowing the collection of bins in an awkward position that may otherwise be difficult to reach. In addition, as further discussed below, this assists in allowing the refuse collection device to operate in one or more automated modes.

By locating the first rotational axis between the first and second chassis rails (which lie in the longitudinal direction of the vehicle), the operating loads of the refuse collection device can be adequately managed.

In an embodiment, the base is configured to be connected to the first chassis rail and the second chassis rail. This assists in providing a stable base for the refuse collection device. In an embodiment, the base is a subframe.

In a preferred form, one or more actuators are configured to rotate the rotating member relative to the base.

In an embodiment, in use, the first rotational axis is substantially vertical.

The rotating member may be located approximately central to the base.

In an embodiment, the refuse collection device includes a guiding member. In a further embodiment, the guiding member is configured to support and guide movement of the extension member.

The guiding member may comprise the rotating member, or may be mounted thereto or integral therewith.

In an embodiment, the guiding member includes a hollow portion that receives the extension member therein. In this form, the extension member is configured to slide relative to the guiding member, ideally in a reciprocating telescoping manner. The movement of the extension member may be driven from a means within the guiding member or by an external means, such as an external hydraulic ram.

In an embodiment, the refuse collection device includes a counterbalance weight. In one form the counterbalance weight is connected to the guiding member, eg. at or adjacent an end of the guiding member distant from the extension member. The counterbalance weight assists in counteracting the weight of the other components of the device and of a bin during lifting and lowering.

The lifting member can be an arm, configured to rotate in use relative to the extension member from a generally downwardly extending position to a generally upwardly extending position (and further), about the second rotational axis. This axis may be substantially perpendicular to the longitudinal direction of the extension member, and is thus arranged in a substantially horizontal direction in use. This articulation allows movement of the bin to a waste disposal position and return to the collection location in the original orientation.

In an embodiment, the bin-grabbing member is rotatably connected to the lifting member. This rotation may take place about a third rotational axis, substantially perpendicular to the longitudinal direction of the lifting member (substantially horizontal in use).

In an embodiment, the bin-grabbing member includes a grab support member having a first support part, pivotally connected to the lifting member about the third rotational axis.

Movement of the first support part may be associated with one or more linkages (eg struts), that may be connected near the third rotational axis. Such linkages can provide advantageous support and/or torsion resistance to the mechanism comprising the lifting member and the bin-grabbing member.

In an embodiment, in response to the lifting member moving towards its substantially upwardly extending position, the first support part is configured to rotate around the third rotational axis relative to the lifting member. This assists in inverting the bin into its waste disposal position above a waste container, and in returning it to the collection location in the correct orientation. In an embodiment, the rotation of the support part about the third rotational axis is dependent on the orientation of the bin.

In an embodiment, the bin-grabbing member is configured to rotate relative to the lifting member about a fourth, slewing axis. This provides further flexibility in collecting and retuning the bin. The grab support member may include a second support part rotatably connected to the first support part about the fourth rotational axis. In one form, the second support part is moved with the assistance of an actuator.

In an embodiment, the fourth rotational axis is positioned transversely to the third rotational axis. The fourth rotational axis may lie in a direction substantially perpendicular to the third rotational axis.

In an embodiment, the bin-grabbing member includes one or more bin-grabbing arms, rotatably connected to the grab support member. In an embodiment, the one or more bin-grabbing arms are rotatably connected to the second support part.

In an embodiment, the bin-grabbing member includes two arms, arranged to rotate from an open, mutually remote, position to a closed, mutually closer, position. In the open position, the arms are able to receive a bin therebetween, and in that position the arms are at a predetermined position providing an optimum separation to receive the bin. In an embodiment, in the predetermined position, the arms are not fully open. In the closed position, the arms are configured to hold the bin therebetween. In an embodiment in that position, the arms are not in their fully closed position.

In an embodiment, movement of the one or more arms from the open position to a closed position is independent from the movement of the grab support member around the fourth axis.

In an embodiment, the arms are configured to move in a substantially identical manner during operation. In an embodiment, an actuator associated with each arm moves in a substantially identical manner. In a further form, the arms include a mechanical linkage that causes the arms to move in the substantially identical manner based on movement of an actuator.

In one embodiment, the arms may be moved to pre-programmed open positions which are at varying degrees of mutual separation, dependent upon the size and/or location of the bin to be picked up. In this regard, one or more rotary position encoders may be used to provide to signals to a controller indicative of the relative position of the arms.

In an embodiment, the refuse collection device includes one or more limit controls. These assist in preventing over-rotating the articulation of the refuse collection device. In an embodiment, the one or more limit controls assist in avoiding interference or collision between components.

In an embodiment, the refuse collection device includes or is associated with a safety detection system. In an embodiment, in response to detecting an individual or object in a work area associated with the refuse collection device, the safety detection system is configured to lockout further movement of the refuse collection device, at least until its associated work area is determined to be clear. This improves the safety of operation of the refuse collection device and the refuse collection vehicle to which it is mounted.

In an embodiment, the refuse collection device can be operated in one or more operating modes.

In an embodiment, the one or more operating modes includes a manual mode, whereby an operator can control all or most of the movement of the refuse collection device. In an embodiment, a video camera is used to assist the operator. In an embodiment, in manual mode, control inputs can be used to allow the refuse collection device to articulate about one or more of the rotational axes simultaneously.

In an embodiment, the one or more operating modes includes an automated mode. The automated mode may be a semi-automated mode and/or a fully automated mode. The automated mode provides a means to increase productivity and reduce emissions and wear of mechanical components by allowing the refuse collection vehicle to pick up bins in a more efficient and speedier manner.

In an embodiment, in the automated mode, a control system can be used to assist in determining the location of a bin. To this end, the control system may include a bin detecting and locating system. The system may further enable bin identification, to determine the type of bin and make decision based on that information.

To detect a bin, determine its location, and/or identify the bin in automated mode, the control system may be configured to receive information from one or more sensors and, optionally, from an operator.

In another aspect the invention resides in a refuse collection vehicle, the vehicle including:

- a chassis having a first longitudinal chassis rail and a second longitudinal chassis rail;
- a waste container supported by the chassis; and
- a refuse collection device comprising:
- a base connected to the chassis;
- a rotating member rotatably connected to the base about a first rotational axis;
- an extension member supported by the rotating member and configured to extend relative to the rotating member;
- a lifting member rotatably connected to the extension member for rotation about a second rotational axis; and
- a bin-grabbing member connected to the lifting member, the bin-grabbing member being configured to collect a bin,
- wherein the first rotational axis is located between the first longitudinal chassis rail and the second longitudinal chassis rail.

In an embodiment, the refuse collection device is located between the waste container and a cabin of the vehicle. In an embodiment, the base is connected to the first longitudinal chassis rail and the second longitudinal chassis rail.

In an embodiment, a central longitudinal axis extends between the first chassis longitudinal rail and the second longitudinal chassis rail. In an embodiment, the rotational axis of the rotating member substantially coincides with the central longitudinal axis.

In an embodiment, the refuse collection device extends from a longitudinal side of the refuse collection vehicle to form a side loading refuse collection vehicle.

In another aspect the invention resides in a method of operating a refuse collection vehicle, the method including the steps of:

- rotating a rotating member about an axis position between a first longitudinal chassis rail and a second longitudinal chassis rail of the refuse collection vehicle,
- extending an extension member relative to the rotating member,
- moving a bin-grabbing member relative to the extension member so to collect a bin, and
- rotating the bin to deliver waste to a waste container of the refuse collection vehicle.

As will be understood from this specification, the invention provides a refuse collection device which addresses at least in part one or more of the disadvantages or problems noted above or at least provides a useful alternative.

Further features and advantages of the present invention will become apparent from the following detailed description.

BRIEF DESCRIPTION OF THE DRAWINGS

By way of example only, preferred embodiments of the invention will be described hereinafter with reference to the accompanying figures, wherein.

DETAILED DESCRIPTION OF THE EMBODIMENTS

Figure 1:
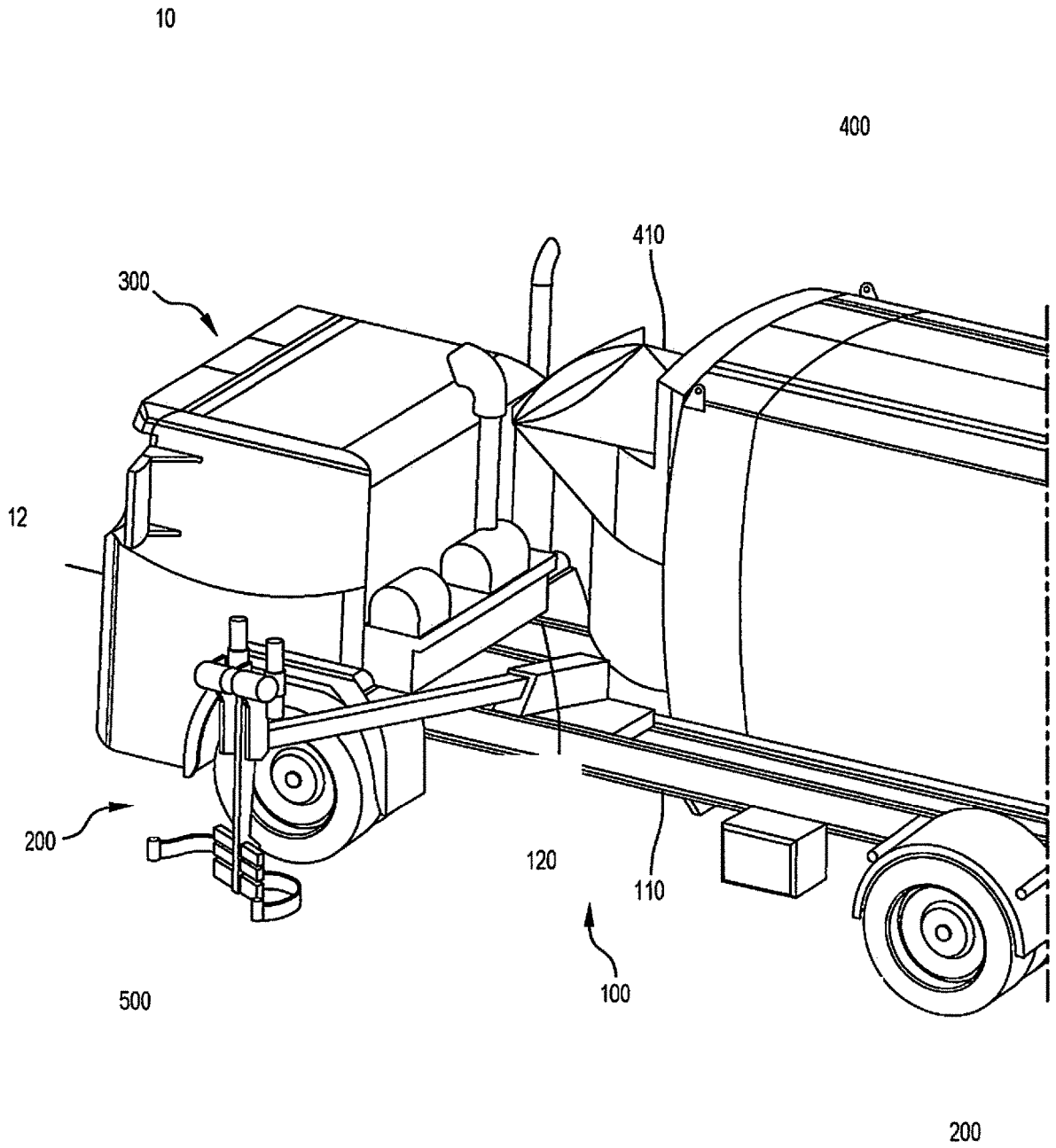
FIG. 1 illustrates a refuse collection vehicle, according to an embodiment of the invention.

FIG. 1 illustrates a refuse collection vehicle 10. The refuse collection vehicle 10 includes a chassis 100, wheels 200, a cabin 300, a waste container 400 with collection hopper 410, and an articulated refuse collection device 500.

The chassis 100 includes a first chassis rail 110 and a second chassis rail 120. Vehicle 10 has a central longitudinal axis 12 centrally located between the first and second chassis rails 110, 120. The cabin 300 and waste container 400 are supported by the first and second chassis rails 110, 120, with cabin 300 located towards the front of the vehicle 10 and waste container 400 located towards the rear. Collection hopper 410 provides a rubbish receiving means into waste container 400, into which the contents of bins are emptied by an articulated refuse collection device 500. The waste container 400 includes a compactor (not shown) to assist in compacting waste therein.

As FIG. 1 shows, the articulated refuse collection device 500 (illustrated in further detail in FIG. 2) is located between the cabin 300 and the waste container 400 in a forward region of the vehicle 10. The articulated refuse collection device 500 includes a base 510, a rotating member 520 having a guiding member 530, an extension member 540, a lifting member 550, a bin-grabbing member 560 and a utility guide chain 570.

The base 510 includes a supporting plate 512 connected between two supporting rails 514, 516. The base 510 is connected to the chassis rails 110, 120 via mounting brackets attached to supporting rails 514, 516 and supporting plate 512. In this regard, the supporting plate 512 extends laterally across the central longitudinal axis 12 between the supporting members 514, 516. The mounting brackets are attached to chassis rails 110, 120 by means of suitable fasteners.

Figure 2:
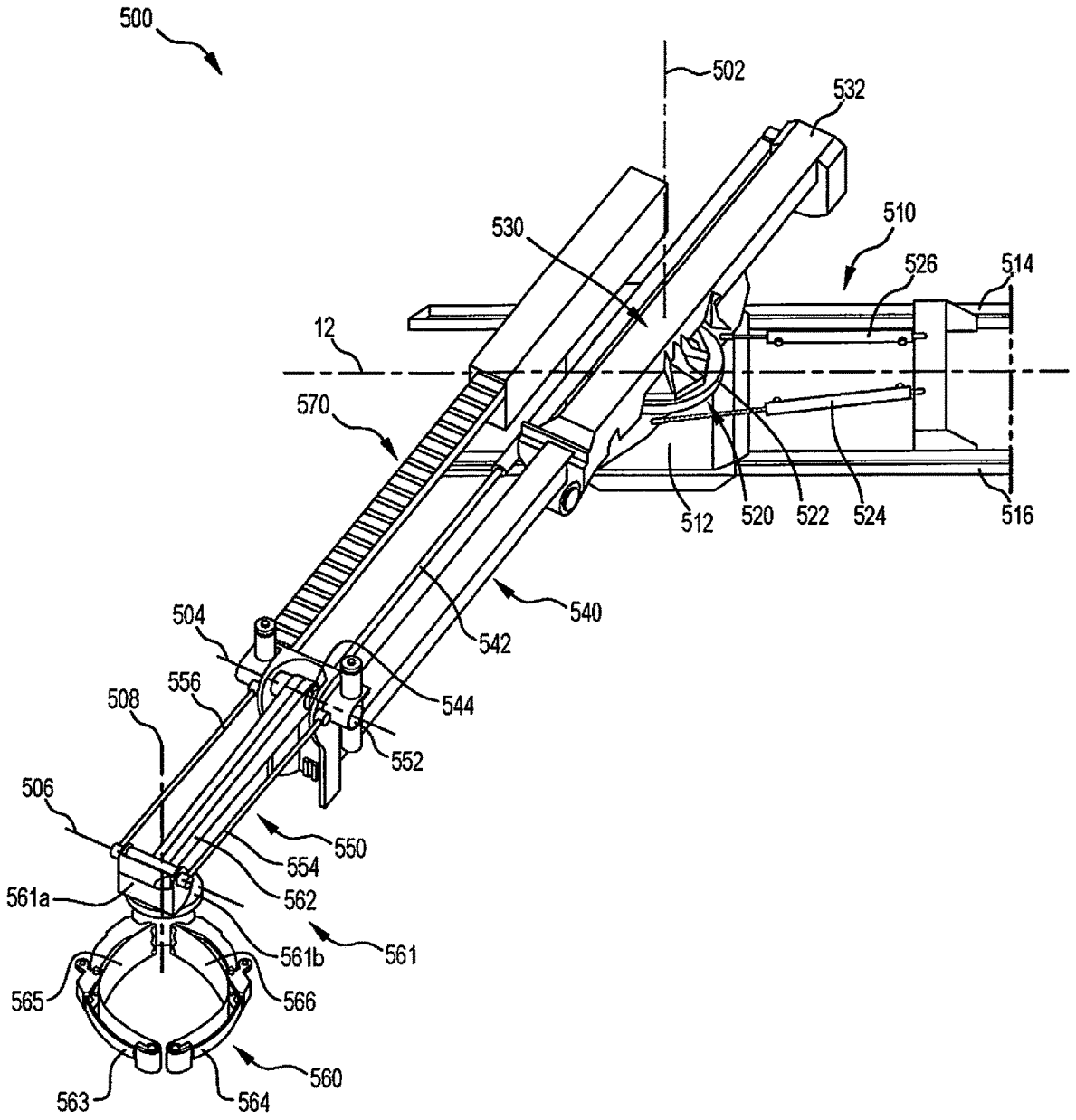
FIG. 2 illustrates a refuse collection device, from the refuse collection vehicle in FIG. 1, according to an embodiment of the invention.

The rotating member 520 includes a slew ring 522. The axis of rotation of the slew ring 522 is defined by the vertical axis 502, which is located between the first and second chassis rails 514, 516, substantially coincident with central axis 12. As FIG. 2 shows, slew ring 522 is located on a central portion of the supporting plate 512.

The slew ring 522 is connected to the guiding member 530. Actuators in the form of hydraulic rams 524, 526 are connected between base 510 and guiding member 530, and are configured to move in opposite directions in order to rotate the slew ring 522 and therefore guiding member 530 about axis 502. With a suitable hydraulic circuit, this affords a straightforward way of ensuring the hydraulic flow rate and applied force are the same in both directions, thus simplifying the control software in providing the ability to determine the appropriate action to take to position the device.

In an alternative embodiment, slew ring 522 (and guiding member 530) may be rotated about axis 502 by a single hydraulic ram. To ensure uniform piston movement in both directions (thereby ensuring that rotation of guiding member 530 is the same in both directions), the hydraulic ram is coupled to a regenerative circuit (regen spool) configured to deliver hydraulic fluid from the annulus end of the cylinder to the full bore end (or blind end) of the cylinder during extension of the piston. The ratio of the cross-sectional area of the full bore end to that of the piston rod is 2:1—this ensures that the cylinder force and velocity is the same in extension and retraction of the piston.

In alternative embodiments, it will be appreciated that the actuators 524, 526 could be replaced by other forms of actuator, for example, by servo drives.

A rotary positional encoder is configured to provide positional feedback to an operational controller on the rotational position of the guiding member 530. The rotary encoder is arranged to measure the rotational position of the slew ring 522 in order to provide a signal which corresponds to the angular position of the guiding member 530. Furthermore, one or more limit controls assist in ensuring that the rotating member 520 and/or the guiding member 530 do not rotate beyond set limits. As outlined further below, the limit controls may be determined by hardware stops and/or software.

The guiding member 530 comprises an elongated square hollow section, with a counterbalance weight 532 attached at one end. The counterbalance weight 532 assists in balancing the weight of the articulated refuse collection device 500, including the weight of a bin during a bin collection and emptying operation. At an opposite end, the guiding member 530 has an open end to receive the extension member 540 in a sliding manner therein.

The extension member 540, which takes the form of a longitudinal arm of generally rectangular section, is configured to move relative to the rotating member 520 by sliding within the guiding member 530. An actuator in the form of ram 542 is arranged in connection between the guiding member 530 and the extension member 540. Operation of the ram 542 in opposite directions respectively extends and retracts the extension member 540 relative to the guiding member 530. In this regard, it will be appreciated that, in use, the extension member 540 moves in a linear manner in a horizontal direction.

A position encoder is arranged to provide feedback to the operational controller on the position of the extension member 540. For this purpose, the position encoder may be mounted to the guiding member 530, the extension member 540 or the ram 542, in accordance with design preferences. The position encoder may be a roller encoder, mounted to guiding member 530 and including a roller configured to engage an outer surface of extension member 540 and thus to rotate in a first direction as extension member 540 extends relative to guiding member 530, and in the opposite, direction as extension member 540 retracts relative to guiding member 530. Rotation of the roller thus provides an accurate measure of the position of extension member 540 relative to guiding member 530.

As shown in FIG. 2, the lifting member 550 takes the form of a longitudinal arm of generally rectangular section, journaled to the outer end of the extension member 540 to rotate about a horizontal axis 504. To this end, the extension member 540 includes a vertical plate 544 at its outer end carrying journal bearings at an upper portion thereof, to which the lifting member 550 is connected. An actuator in the form of a rotary actuator 552 is configured to effect rotation on the lifting member 550 about the axis 504. A rotary positional encoder is arranged to provide positional feedback to the operational controller on the rotational position of the lifting member 550, ie. the rotary encoder is arranged in a manner to track the rotation of lifting member 550 about axis 504 relative to extension member 540. One or more limit controls also assist in ensuring that the lifting member 550 does not rotate beyond prescribed limits, which may be physical stops or determined by control software.

Figure 3:
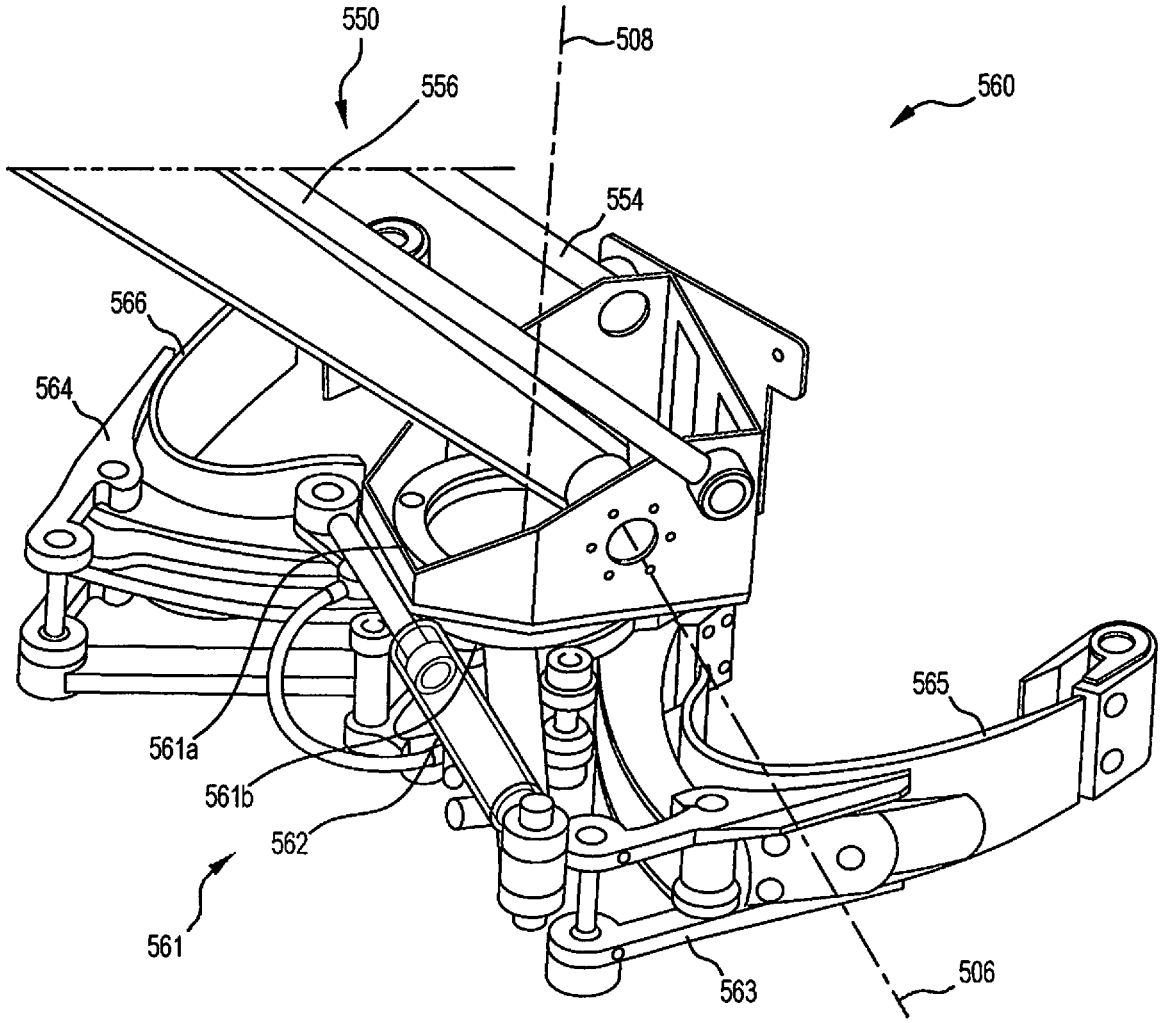
FIG. 3 illustrates a bin-grabbing member of the refuse collection device in FIG. 2, according to an embodiment of the invention.

The bin-grabbing member 560, shown further in FIG. 3, is configured to grab and hold a bin. The lifting member 550 is connected to the bin-grabbing member 560 by way of a dual arrangement as discussed below, to allow rotation of bin-grabbing member 560 about two orthogonal rotational axes which are perpendicular to the longitudinal direction of lifting member 550. The bin-grabbing member 560 includes a grab support member 561 with a first support part 561*a* pivotally connected to the lifting member 550. As outlined further below, linkages in the form of struts 554, 556 assist in controlling and providing a bin tipping operation whilst a bin lifting operation is underway.

Bin-grabbing member 560 is mounted to lifting member 550 by way of a plastic bushing, to allow rotation therebetween about rotational axis 506, which lies in a horizontal direction. The connections between the first support part 561*a* and the struts 554, 556 are offset from axis 506. Accordingly, in combination with rotation of lifting member 550 relative to extension member 540, rotation of bin-grabbing member 560 about axis 506 assists in emptying the bin into the collection hopper 410. In particular, the struts 554, 556 assist in rotating the first support part 561*a* about the axis 506 at an upper portion of the lifting cycle. This allows the bin to be tipped in an inverted manner.

Separately, the grab support member 561 includes a second support part 561*b* rotatably connected to the first support part 561*a*. Plastic plates are located between first and second support part 561*a*, 561*b* to assist with the rotation therebetween. An actuator 562 affords rotation of the second support part 561*b* about a second slew axis 508, and a rotary positional encoder is used to provide positional feedback to the operational controller on the rotational position of the second support part 561*b* about its axis 508.

The bin-grabbing member 560 includes two arms 563, 564 pivotally connected to the grab support member 561. The arms 563, 564 are configured to rotate from an open position, where the arms are a sufficient distance apart to receive a bin therebetween, to a relatively closed position, where the arms can grippingly hold the bin therebetween. To assist holding the bin, the arms 563, 564 each include a tension belt 565, 566. The arms 563, 564 can be moved to pre-programmed open positions which are at varying degrees of mutual separation, dependent upon the size and/or location of the bin to be picked up. In this regard, it will be appreciated that one or more rotary positional encoders are used to provide to the operational controller signals indicating the relative position of arms 563, 564. The arms 563, 564 are driven by separately synced actuators but, in further embodiments, it will be appreciated that the arms 563, 564 may be coupled together to provide movement in a substantially identical manner with one actuator. In this regard, the arms 563, 564 are designed to move in unison between the open and relatively closed positions.

Utility guide chain 570 provides a means to flexibly support cabling to provide power and control signals to the actuators as well as feedback signals from the position encoders.

Vehicle 10 may be equipped with a safety detection system (not shown), configured to detect a person or object in an associated work area of the articulated refuse collection device 500 and, in response to detecting an person or object, lock device 500 until its associated work area is determined to be clear, and/or provide a suitable warning signal to an operator via the operational controller. To detect the person or object, a suitable sensor (for example, an image recognition or movement sensor) may be employed, and this may be mounted to the articulated refuse collection device 500 or on another part of vehicle 10 in the vicinity of device 500.

As will be understood, the articulated refuse collection device 500 affords a very manoeuvrable manipulation of a bin between an at-rest position on the ground to a content emptying position over the collection hopper 410 and back again. Rotation about slew axis 502 provides the ability to manoeuvre bin-grabbing member 560 to a desired position, which may be substantially forward or rearward of the position of mounting base 510. This allows the device to reach bins in orientations and positions that would otherwise be difficult or impossible to reach, without the need for fine positioning of the refuse collection vehicle itself. The rotation of bin-grabbing member 560 about second slew axis 508 provides still further manoeuvrability for bin engagement.

It will be appreciated that, when in its home, stowed position, articulated refuse collection device 500 does not protrude from the side of vehicle 10, ie. it fits within the vehicle profile. Furthermore, to assist with controlling the refuse collection device 500, and in order to assist in keeping the refuse collection device 500 substantially safe during a hydraulic failure, the actuator(s) in the present invention are fitted with a counterbalance valve. In this regard, the refuse collection device 500 is substantially prevented from, for example, freely swinging from its stowed position during non-collection driving (e.g. highway driving), becoming a dangerous hazard, in the event that a hydraulic line fails.

In use, the refuse collection vehicle 10 may be operated in at least three operating modes: i) a manual mode; ii) a semi-automated mode; and/or iii) a fully automated mode. Each of these modes will be discussed in turn below.

In manual mode, an operator of the refuse collection vehicle 10 uses a joystick controller to manoeuvre the bin-grabbing member 560 to a required bin pickup location. More particularly, once the collection vehicle 10 is stopped, by use of the joystick, the bin-grabbing member 560 is extended towards a bin by extending the extension member 540. If required (again, by use of the joystick) the operator may rotate the rotating member 520 and hence guiding member 530 and the extension member 540. In the event that, for example, an obstacle is partially blocking the bin, rotation of bin-grabbing member 560 about the slew axis 508 enhances the ability to reach and grab the bin. The limit controls prevent the over-rotation of the various components during operation when the operator is using the joystick controller.

It is noted that when using the joystick controller in manual mode, to streamline the control of more than one axis, it is possible to couple, for instance, the rotational movement about slew axis 502 with that around slew axis 508. Similarly, the movement of extension member 540 may be coupled with the rotation of the lifting member 550 about axis 504 such that, depending on the status of the lift cycle, the movements of the extension member 540 and lifting member 550 are controlled in a logical manner in the bin lifting and replacement operation. Software and/or hardware limits may limit the motion of the combined control to avoid collision of one part of the device with other parts of the device or vehicle. Further, the system may be configured such that if one degree of movement needs to be controlled alone, the joystick controller may be switched into a further mode to control movement, eg, movement about a selected axis. This arrangement therefore allows the operator to control multiple axes with manipulation of a single joystick, as well as providing the flexibility to control a single degree of movement alone if desired.

With the above in mind, when the bin-grabbing member 560 is at the required bin pickup location, the arms 563, 564 are in an open position and substantially surround the bin. The open position of the arms 563, 564 may be at predetermined positions such that the arms are at an optimum distance apart to ensure relatively quick pick up of the bins and to minimise interference with surrounding objects, such as neighbouring bins or street furniture. The operator then moves the arms 563, 564 to a relatively closed position where the arms 563, 564 grip the bin therebetween. Lifting member 550 may then be actuated to lift the bin, whilst the extension member 540 is retracted, in order to move the bin to an emptying position over collection hopper 410. Again, limit controls, assisted by the position encoders and/or hardware stops, prevent over rotation or collision of parts of the device 550 with other parts of the device or vehicle.

When the lifting arm has moved the bin towards the upper part of the lifting cycle (i.e. where the bin has been rotated past a substantially horizontal direction), the bin commences a tipping arc around axis 506. That is, the rotation of the struts 554, 556, relative to the rotation of the lifting member 550, further pulls the first support part 561*a* about the axis 506. This tips up the bin to allow the emptying of its contents into collection hopper 410. From there, the waste travels into the waste container 400 after being delivered into the chute 410, where it is then compacted with the compaction mechanism.

Once the bin has been emptied, it is returned to the ground through a reverse operation to the lifting and emptying operation, again under control of the joystick.

In the semi-automated mode, a controller works with the assistance of an operator and sensors to locate and retrieve bins, with some aspects of the operational cycle being programmed.

In the fully automated mode, the controller relies on the feedback from the various encoders (and other sensors, as required) to identify a bin and its location, to pick up the bin and deliver its waste to the waste container 400, and to return the bin to the ground, without the need for active operator control.

As will be appreciated, by locating the rotational axis 502 between the chassis rails 110, 120, the operating loads of the refuse collection device 500 can be adequately managed. For example, large cantilever loads may be avoided. As the centre of mass of the articulated refuse collection device 500 is located close to the central longitudinal axis 12 of the vehicle, this assists with the dynamic handling of vehicle 10. Moreover, due to its central location, the refuse collection device 500 can easily be adapted for both left-hand and/or right-hand drive vehicles.

The slew axes 502, 508 provide the refuse collection device 500 with particularly powerful flexibility in the bin collection operation. This reduces the need to accurately position the refuse collection vehicle 10 to pick up a bin. Furthermore, as will be appreciated, bins can be more readily collected when surrounding obstacles restrict access or road layouts are difficult to navigate.

In addition, providing this additional flexibility in the bin collection operation, allows the introduction of a greater level of automation to the bin collection operation. In the present invention, the automatic modes provide a means to increase efficiency, which in turn increases productivity and reduces emissions and mechanical wear on components.

The structural components of the refuse collection device 500 are constructed of suitable mild steel, as will be understood other suitable materials may be utilised for some or all components. Supporting plate 512 (and possibly other parts) are preferably fabricated from a high strength structural steel plate such as GR350 stock.

Furthermore, the present invention allows the vehicle operator to pay greater attention to road hazards and other risk factors by reducing the level of concentration required to pick up, empty and replace bins.

In this specification, adjectives such as left and right, top and bottom, first and second, and the like may be used to distinguish one element or action from another element or action without necessarily requiring or implying any actual such relationship or order. Where context permits, reference to a component, an integer or step (or the like) is not to be construed as being limited to only one of that component, integer, or step, but rather could be one or more of that component, integer or step.

The above description relating to embodiments of the present invention is provided for purposes of description to one of ordinary skill in the related art. It is not intended to be exhaustive or to limit the invention to a single disclosed embodiment. As mentioned above, numerous alternatives and variations to the present invention will be apparent to those skilled in the art from the above teaching. Accordingly, while some alternative embodiments have been discussed specifically, other embodiments will be apparent or relatively easily developed by those of ordinary skill in the art. The invention is intended to embrace all modifications, alternatives, and variations of the present invention that have been discussed herein, and other embodiments that fall within the spirit and scope of the above described invention.

In this specification, the terms 'comprises', 'comprising', 'includes', 'including', or similar terms are intended to mean a non-exclusive inclusion, such that a method, system or apparatus that comprises a list of elements does not include those elements solely, but may include other elements not listed.

It will be understood that the invention disclosed and defined in this specification extends to all alternative combinations of two or more of the individual features mentioned or evident from the text or drawings. All of these different combinations constitute various alternative aspects of the invention.

The invention claimed is:

1. A refuse collection device mountable to a refuse collection vehicle to collect and tip bins to empty their contents into a waste container associated with the vehicle, the vehicle having a first chassis rail and a second chassis rail, the device including:

a base;

a rotating member rotatably connected to the base about a first rotational axis that, when in use, is substantially vertical;

an extension member that is supported by the rotating member and configured to extend relative to the rotating member in a direction generally perpendicular to the first rotational axis;

a lifting member rotatably connected to the extension member for rotation about a second rotational axis generally perpendicular to a longitudinal axis of the extension member such that, when in use, the second rotational axis is arranged substantially horizontally; and a bin-grabbing member configured to collect a bin, the bin grabbing member being rotatably connected to the lifting member and configured to rotate relative to the lifting member about a third rotational axis, the bin-grabbing member including a grab support member having a first support part pivotally connected to the lifting member about the third rotational axis, the device configured to mount to the vehicle to locate the first rotational axis of the rotating member between the first chassis rail and the second chassis rail, wherein the lifting member is further configured to rotate relative to the extension member from a generally downwardly extending position to a generally upwardly extending position about the second rotational axis, and wherein when the lifting member moves towards its generally upwardly extending position, the first support part is allowed to rotate about the third rotational axis relative to the lifting member to thereby assist in inverting a bin collected by the bin-grabbing member.

2. The refuse collection device of claim 1, further including a guiding member configured to support and guide movement of the extension member relative to the rotating member.

3. The refuse collection device of claim 2, wherein the guiding member comprises the rotating member, or is mounted thereto or integral therewith.

4. The refuse collection device of claim 2, wherein the guiding member further includes a hollow portion that slidingly receives the extension member therein such that the extension member is configured to slide relative to the guiding member.

5. The refuse collection device of claim 1, wherein the lifting member is an arm.

6. The refuse collection device of claim 5, wherein the third rotational axis is substantially perpendicular to a longitudinal axis of the lifting member such that, when in use, the third rotational axis is arranged substantially horizontally.

7. The refuse collection device of claim 1, wherein the bin-grabbing member is further configured to rotate relative to the lifting member about a fourth, slewing, axis.

8. The refuse collection device of claim 7, wherein the fourth axis is generally perpendicular to the third rotational axis such that, when in use, the fourth axis is substantially vertical.

9. The refuse collection device of claim 1, wherein the bin-grabbing member further includes a second support part rotatably connected to the first support part about a fourth, slewing axis.

10. The refuse collection device of claim 9, wherein the bin-grabbing member includes one or more bin-grabbing arms rotatably connected to the second support part.

11. The refuse collection device of claim 10, further including one or more limit controls configured to prevent over-rotation of any one or more of the rotating member, the lifting member, the bin-grabbing member, a grab support member, the first support part, the second support part, and the one or more bin-grabbing arms.

12. The refuse collection device of claim 1, further including a safety detection system configured to lockout movement of the refuse collection device in response to detecting an individual or object in a work area associated with the refuse collection device.

13. The refuse collection device of claim 1, further configured to be operated in one or more operation modes, including an automated mode in which the refuse collection device can be operated semi-autonomously or fully autonomously, and wherein the refuse collection device includes a control system configured to detect and locate a bin.

14. A refuse collection vehicle, including:

a chassis having a first longitudinal chassis rail and a second longitudinal chassis rail;

a waste container supported by the chassis; and a refuse collection device according to claim 1, wherein the base of the refuse collection device is connected to the chassis such that the first rotational axis is located between the first longitudinal chassis rail and the second longitudinal chassis rail.

15. A method of operating a refuse collection vehicle to collect and tip bins to empty their contents into a waste container associated with the vehicle, the method including the steps of:

rotating a rotating member about a first rotational axis positioned between a first longitudinal chassis rail and a second longitudinal chassis rail of the refuse collection vehicle, wherein the first rotational axis is arranged substantially vertically;

extending an extension member relative to the rotating member in a direction generally perpendicular to the first rotational axis, moving a bin-grabbing member relative to the extension member so to collect a bin, the bin-grabbing member including a grab support member having a first support part pivotally connected to a lifting member, and rotating the bin about a second rotational axis to deliver waste to the waste container of the refuse collection vehicle, wherein said rotating the bin includes rotating the lifting member relative to the extension member from a generally downwardly extending position to a generally upwardly extending position about the second rotational axis, wherein the second rotational axis is generally perpendicular to a longitudinal axis of the extension member and is arranged substantially horizontally, and wherein when the lifting member moves towards its generally upwardly extending position, the first support part is allowed to rotate about a third rotational axis relative to the lifting member to thereby assist in inverting the bin collected by the bin-grabbing member.

* * * * *